United States Patent [19]

Olander

[11] 4,182,197

[45] Jan. 8, 1980

[54] RAILROAD CAR HAND BRAKE

[75] Inventor: Roland J. Olander, LaGrange, Ill.

[73] Assignee: Miner Enterprises, Inc., Geneva, Ill.

[21] Appl. No.: 788,345

[22] Filed: Apr. 18, 1977

[51] Int. Cl.[2] ..... G05G 1/08

[52] U.S. Cl. ..... 74/505; 74/411.5

[58] Field of Search ..... 74/505 R, 411.5, 506; 192/16

[56] References Cited

U.S. PATENT DOCUMENTS

| | | | |
|---|---|---|---|
| 1,000,084 | 8/1911 | Frederickson | 74/505 |
| 1,950,618 | 3/1934 | Lounsbury | 74/505 |
| 2,082,964 | 6/1937 | Lounsbury | 74/505 |
| 2,310,135 | 2/1943 | Van Cleave | 74/505 |
| 2,457,764 | 12/1948 | Williams | 74/505 |
| 2,618,169 | 11/1952 | Mersereau | 74/505 |
| 2,639,628 | 5/1953 | Olander | 74/505 |
| 3,425,294 | 2/1969 | Klasing | 74/505 |
| 3,529,488 | 9/1970 | Natschke | 74/505 |
| 3,826,154 | 7/1974 | Motus et al. | 74/505 |
| 3,988,944 | 11/1976 | Klasing | 74/505 |

*Primary Examiner*—Samuel Scott

*Assistant Examiner*—Don E. Ferrell

*Attorney, Agent, or Firm*—Darbo & Vandenburgh

[57] ABSTRACT

The gear drive from the hand wheel to the chain drum includes a worm wheel coaxial with the chain drum. An idler shaft parallel to the plane of the worm wheel carries a worm engaging the worm wheel and a bevel gear. The hand wheel shaft is parallel to the chain drum shaft and carries a bevel gear engaging the bevel gear on the idler shaft. Between the worm wheel and the chain drum is a release mechanism which includes a release ring which when rotated about the axis of the chain drum is cammed to push a release plate into disengagement position. This release ring has a gear segment thereon which is engaged by a gear segment on a release actuating lever. In a modified embodiment this release lever also carries a cam which urges a brake shoe against a brake drum on the chain drum to apply a restraining force to the chain drum when the release mechanism is released. There is also described a similar type of brake for chain drum drag on a conventional hand brake mechanism which utilizes only spur gears rather than a worm gear drive.

9 Claims, 6 Drawing Figures

RAILROAD CAR HAND BRAKE

BACKGROUND AND SUMMARY OF THE INVENTION

The present invention relates to hand brake mechanism for setting the brakes of railway cars. Such hand brakes are used to manually apply the brakes on a railway car by pulling on a chain connected to the railway car brake rigging. This chain is connected to a rotatable drum of the hand brake mechanism. When a hand wheel is rotated, a gear mechanism interconnecting the hand wheel and the chain drum rotates the chain drum to cause the pulling force to be applied to the chain.

Perhaps the most commonly used of such gear mechanism consists of a plurality of spur gears. This enables the shaft of the hand wheel to be parallel to the shaft of the chain drum which is an advantageous arrangement. However, to maintain the car brakes in the locked position it is necessary that some sort of a locking mechanism, such as a ratchet, be employed. An example of such a brake mechanism will be seen in U.S. Pat. No. 3,353,902.

A gear drive between the hand wheel and the chain drum, which drive includes a worm and worm wheel, is advantageous since it eliminates the necessity for the ratchet mechanism. Hand brakes embodying such drives have been proposed; see for example U.S. Pat. No. 1,854,804. However, to the best of my knowledge these all have required that the hand wheel shaft be at right angles to the chain drum shaft. One feature of my invention is a gear drive arrangement which incorporates a worm and worm wheel, while at the same time maintaining the hand wheel shaft parallel to the chain drum shaft.

While the such hand brakes can be released by a reverse rotation of the hand wheel, it is conventional to include a release mechanism to permit disengagement of the chain drum for free rotation to achieve release of the railway car brakes. Due to the tensioning provided by the brake rigging and the weight of the chain, the reverse rotation of the chain drum, which occurs when the release mechanism is so disengaged, results in a rapid reverse rotation of the drum. To prevent the inertia of the drum from causing a reverse winding of the chain on the drum, a stop often is employed. When this stop is encountered during such release of the chain drum, the inertia results in a substantial impact. It is desirable to retard the rotation of the chain drum when the brake is released through disengagement of the release mechanism, so that the chain and drum do not develop such a rapid rotation. Brakes to retard the rotation of the chain drum upon release of the release mechanism have been proposed. See U.S. Pat. No. 3,979,969.

The herein disclosed embodiments incorporate brakes to retard the rotation of the chain drums when the release mechanisms are released. As compared to such brakes heretofore proposed, the herein disclosed brakes are advantageous in that they are simple in construction requiring a minimum of parts. Furthermore, they are extremely sturdy and reliable to withstand the forces applied thereto, necessary to retard the chain drum rotation, without significant deterioration over years of use. In the present invention, such brakes comprise an annular brake drum with a peripheral braking surface against which a brake shoe is urged by the mechanism utilized to release the release mechanism. The brake shoe is restrained against all but a radial movement toward and away from the brake drum surface. The shoes are cammed toward the surface, with the interposition of a spring, as the release lever is actuated.

Further objects and advantages will become apparent from the following description and the accompanying drawings.

DESCRIPTION OF SPECIFIC EMBODIMENTS

The following disclosure is offered for public dissemination in return for the grant of a patent. Although it is detained to ensure adequacy and aid understanding, this is not intended to prejudice that purpose of a patent which is to cover each new inventive concept therein no matter how others may later disguise it by variations in form or additions or further improvements.

Figure 1:
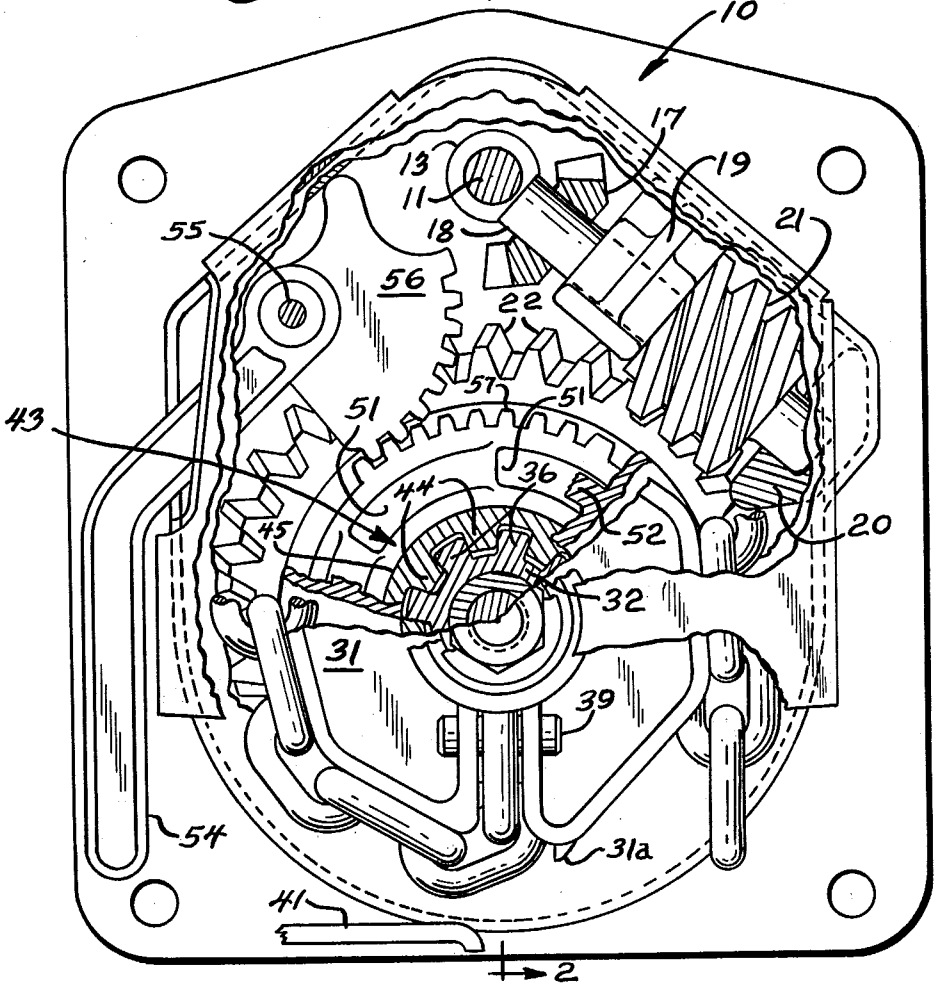
FIG. 1 is a front elevational view, partially broken away, of an embodiment wherein the hand wheel and chain drum shafts are parallel, with a worm drive incorporated into the gearing therebetween.
Figure 2:
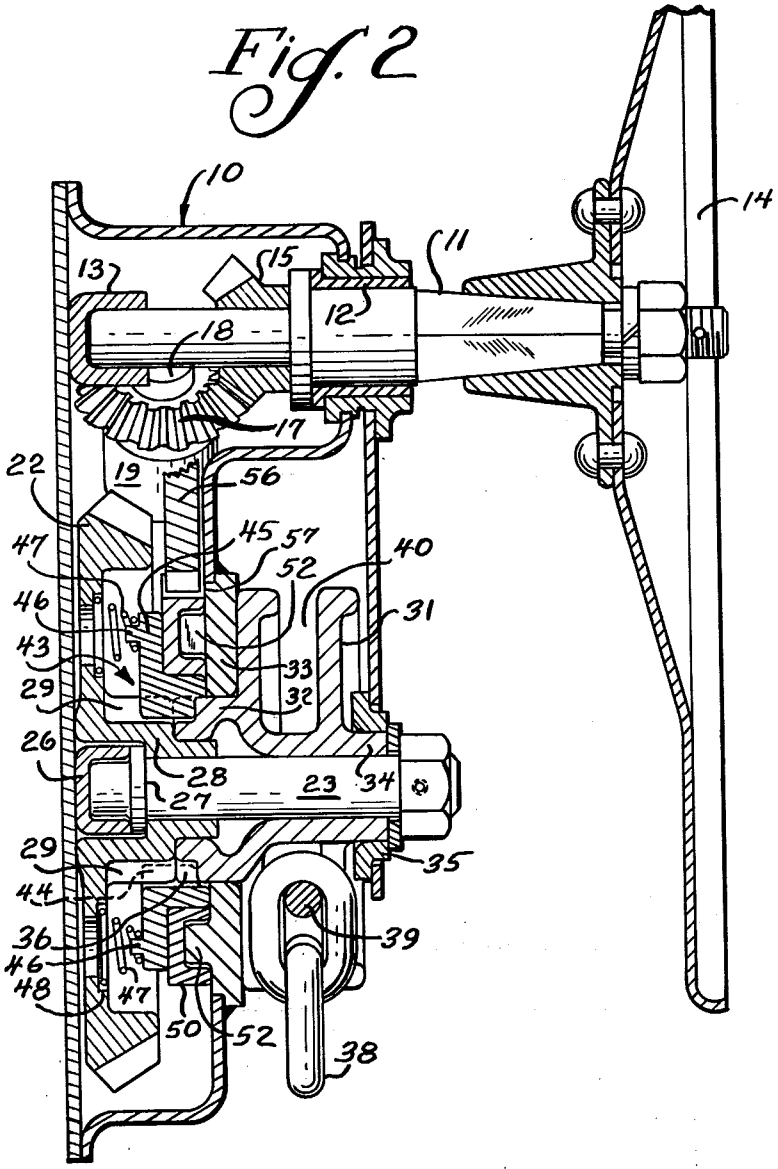
FIG. 2 is a section as seen at line 2—2 of FIG. 1.

Referring to the embodiment of FIGS. 1 and 2, there is a frame, generally 10, which also forms a housing for the hand brake mechanism. A hand wheel shaft 11 is journaled in this frame by means of bearings 12 and 13. Externally of the housing a hand wheel 14 is secured to this shaft and internally of the housing a bevel gear 15 also is attached to the shaft.

Bevel gear 15 engages a bevel gear 17 attached to an idler shaft 18. Idler shaft 18 is rotatably mounted in bearings 19 and 20. A helical gear or worm 21 also is secured to shaft 18. This worm engages a worm wheel 22 which is mounted for rotation about the axis of a chain drum shaft 23.

The rear end of shaft 23 is held in a bearing 26 secured to frame 10 and has a flange 27 externally of that bearing. Worm wheel 22 includes a hub 28 rotatably mounted on shaft 23 and abutting flange 27. A plurality of splines 29 are formed on the exterior of the hub 28. A chain drum 31 is mounted on shaft 23 for rotation about the axis of that shaft. This chain drum has a rear hub 32 journaled in a bearing 33 forming a part of the frame 10. It also has a front hub 34 journaled in frame bearing 35. The rearmost portion of rear hub 32 also is journaled on the forward portion of hub 28 of the worm wheel. Hub 32 also has splines 36 on the exterior thereof.

A chain 38 leading to the brake rigging (not shown) is suitably connected to chain drum 31 in one of the manners well known in the art. In the illustrated embodiment this is done by means of a pin 39 which passes through the end link of the chain and is held by the chain drum, but one of the other known procedures might be employed, such as projections on the drum which extend through the links. In a conventional manner, the drum has a central aperture 40 into which alternate links can project and the periphery has a plurality of flats against which the other alternate links can lay. In FIG. 1, the chain is shown completely wound on the durm as would be the case when the car brakes were drawn against the car wheels to brake the car; while in FIG. 2 the chain is shown unwound from the drum as would be the case when the car brakes were released. At that time the chain abuts a stop 41 forming a part of frame 10.

A release mechanism, generally 43, includes splines 29 on the worm wheel and splines 36 on the chain drum. These splines are engaged by internal splines 44 on the hub of an annular release plate 45. At one side of the release plate are protrusions 46 employed to hole one end of release springs 47. The other ends of the springs are seated in depressions 48 in the face of worm wheel 22. A release ring 50 has one side bearing against the opposite face of the release plate. The other face of the ring has a series of ramps or cams 51 formed therein. These cams bear against a complementary set of ramps or cams 52 on the plate bearing 33 which is a part of frame 10. Thus as the release ring 50 is rotated (in a counterclockwise direction as viewed in FIG. 1) the release ring is cammed in the direction of release plate 45 (to the left as viewed in FIG. 2). This causes the release plate to move, against the resistance of springs 45, fully onto the hub of the worm wheel so that the splines 44 of the release plate become disengaged from the splines 36 of the chain drum. At this disengagement position of the release mechanism 43 the chain drum is free to rotate independently of the worm wheel 22.

The actuating mechanism for the release mechanism comprises a handle 54. This handle is non-rotatably mounted on a shaft 55 rotatably mounted in frame 10. A gear segment 56 is integral with the shaft and engages a gear segment 57 on the periphery of release ring 50. Thus as handle 54 is pivoted upwardly from the position illustrated in FIG. 1, the release ring 50 is rotated in a counterclockwise direction as viewed in FIG. 1 to cause disengagement.

With the railway car brakes released (chain 38 being unwound from chain drum 31) those brakes can be set by rotating hand wheel 14 in a direction such that chain drum 31 turns in a counterclockwise direction. When the brakes are set to the desired degree, that setting will be retained without more than the operator releasing his grip on hand wheel 14 since the worm drive 21, 22 is self-locking. If the car brakes are to be released, this may be done in one of two ways. A gradual release may be achieved by a reverse rotation of hand wheel 14. Alternatively, a quick release is obtained by pivoting handle 54 upwardly so as to cause release mechanism 43 to disengage in the manner previously described. With the mechanism disengaged, the pull on chain 38 caused by the brake rigging causes chain drum 31 to rotate in a clockwise direction as viewed in FIG. 1. When the chain is fully unwound from the chain drum, it extends vertically down from pin 39 and is pinched between stop 41 and stop 31*a* on the chain drum. This prevents further rotation of the chain drum. There is likely to be a substantial impact upon chain 38 striking stop 41. To alleviate problems that may be caused thereby, a retarding force may be applied to the chain drum as described in connection with the embodiment of FIGS. 3–4. After the chain is fully unwound from the chain drum, handle 54 is again lowered, whereupon springs 47 move release plate 45 and releases ring 50 to the right as viewed in FIG. 2. At this time the splines 44 on the release plate reengage the splines 36 of the chain drum to cause reengagement of the release mechanism.

Figure 4:
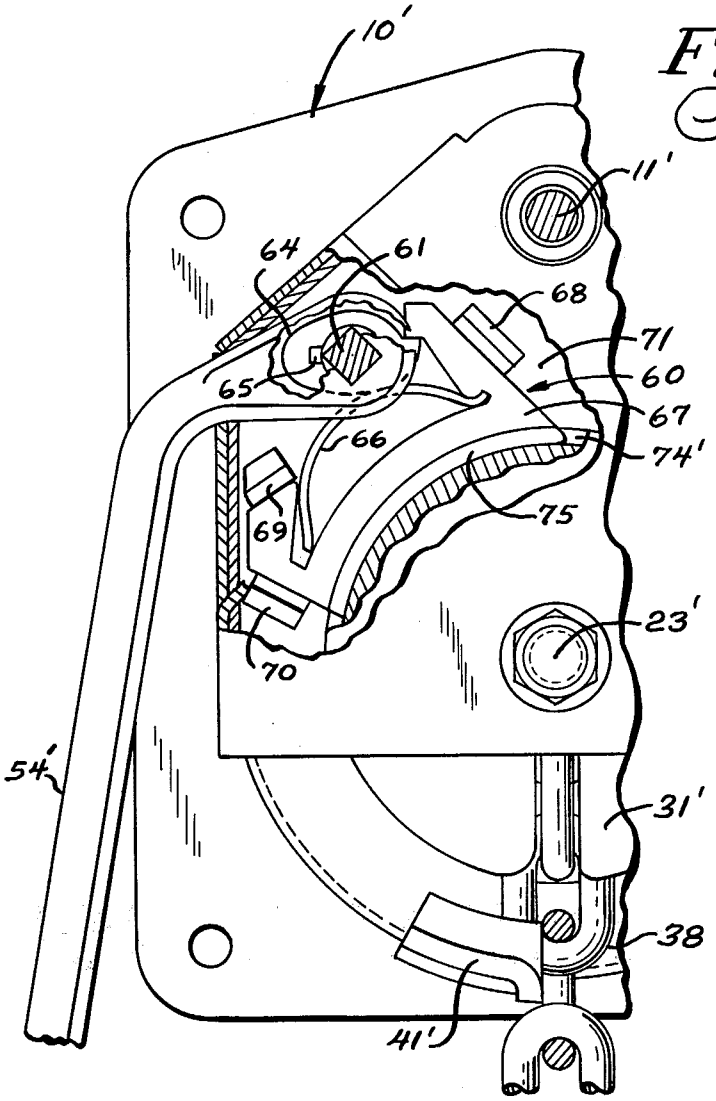
FIG. 4 is a partial front elevational view of the embodiment of FIG. 3, with portions broken away.
Figure 3:
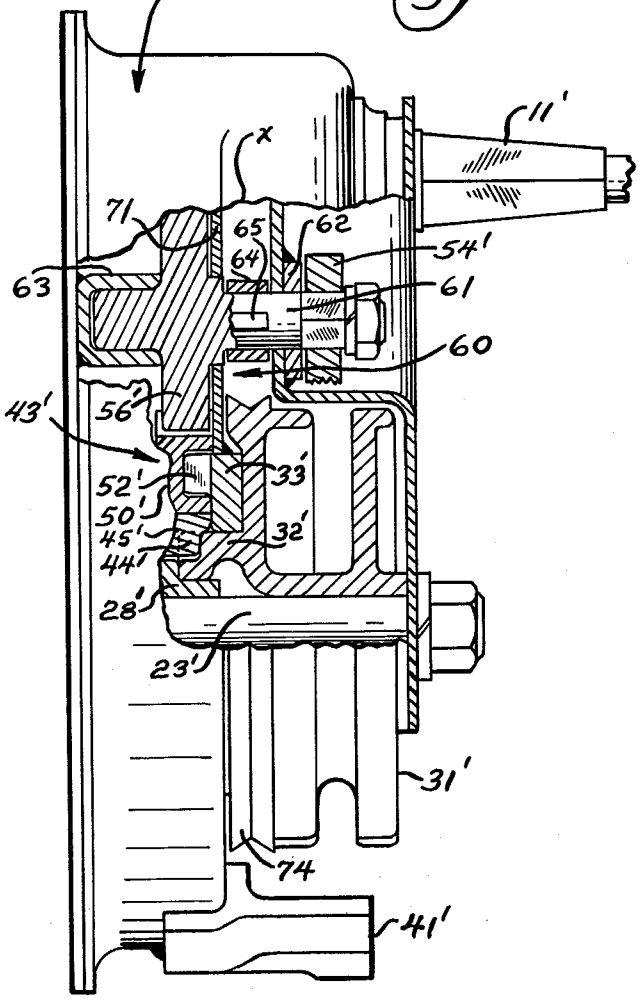
FIG. 3 is a side elevational view, with portions broken away, illustrating a modification of the embodiment of FIGS. 1-2 to incorporate a brake for the chain drum actuated upon release of the release mechanism in the drive train.

In the main, the embodiment of FIGS. 3 and 4 corresponds to the embodiment of FIGS. 1 and 2 just described. To the extent that the components are similar, corresponding numbers have been employed with a prime after the numbers in FIGS. 3 and 4. In addition, FIGS. 3 and 4 illustrate a brake, generally 60, employed to retard the rotation of the chain drum 31' when the release mechanism 43' is disengaged. In this embodiment, the release handle 54' is non-rotatably secured to its shaft 61. Shaft 61 is rotatably journaled in bearings 62 and 63 of frame 10. Release gear segment 56' is an integral part of this shaft. A cam 64 is non-rotatably held on the shaft by means of a key 65.

Cam 64 bears against a spring 66 which in turn bears against a brake shoe 67. By means of stops 68-70 brake shoe 67 is restrained against movement other than in a radial direction to and from the axis of shaft 23'. The stops are secured to wall 71 of frame 10'.

Chain drum 31' includes a brake drum which forms a concave vee-shaped surface 74. The brake shoe has a complementary configuration comprising a convex vee surface 75 extending into the brake drum groove. The use of vee surfaces has two advantages, namely, the brake shoe is self-centering on the brake drum and the surface contact area between the two is increased.

When the release mechanism 43' is released by the raising of handle 54', as previously described in connection with FIGS. 1 and 2, cam 64 applies pressure to spring 67 in a direction radially towards the axis of shaft 23'. In turn, the spring applies a corresponding pressure to brake shoe 67. The frictional contact thereby obtained between the brake shoe and the brake drum retards the rotation of chain drum 31' as the chain unwinds therefrom. Thus when the chain reaches the bottom and strikes the stop 41' the force of the impact is significantly lessened. When the handle 54' is lowered to reengage the release mechanism 43', the force applied by cam 64 to the brake shoe is relieved. The brake shoe and/or the brake drum may be manufactured of a composition or fiber material or lined with the same to establish the coefficient friction between the two to a degree to achieve the desired braking effect.

Figure 5:
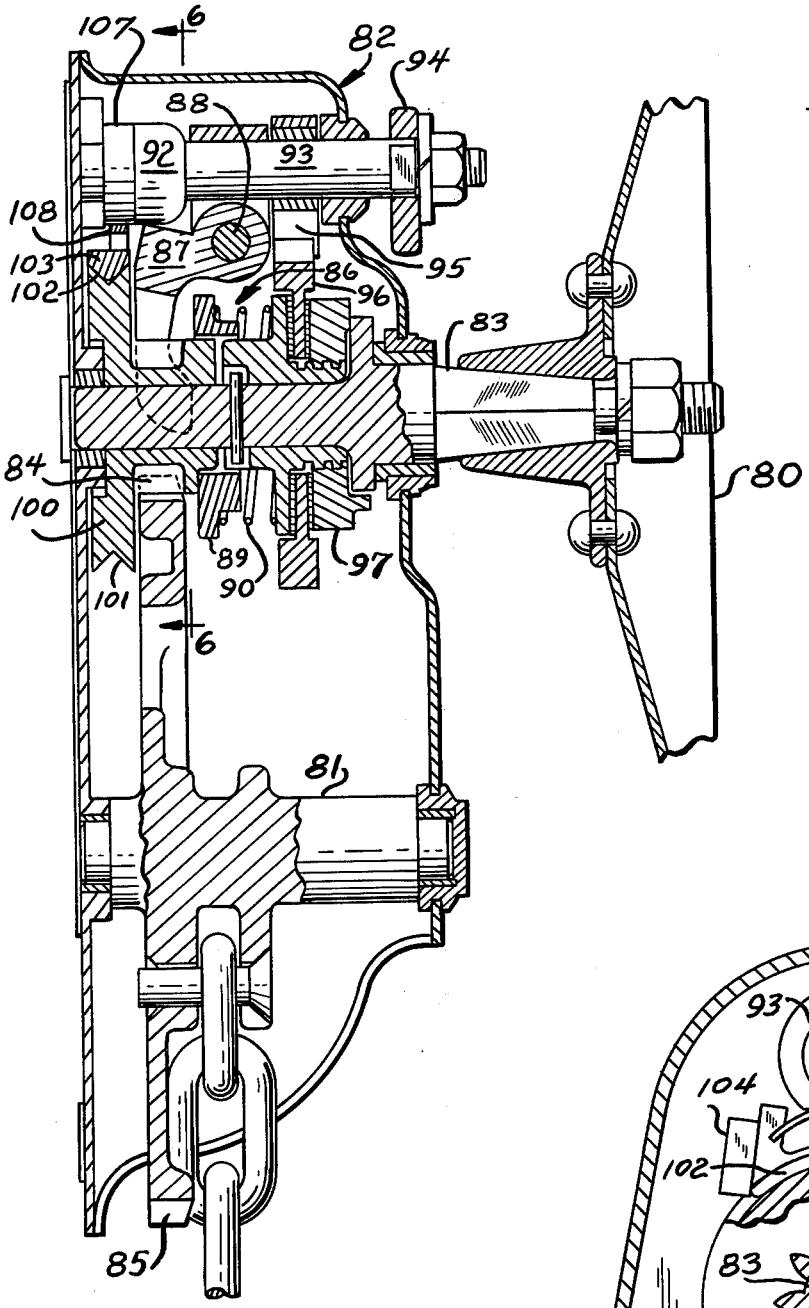
FIG. 5 is a vertical section through a brake drum mechanism which utilizes only spur gears in the drive train between the hand wheel and the chain drum and illustrates a brake to retard the rotation of the chain drum upon release of the release mechanism.
Figure 6:
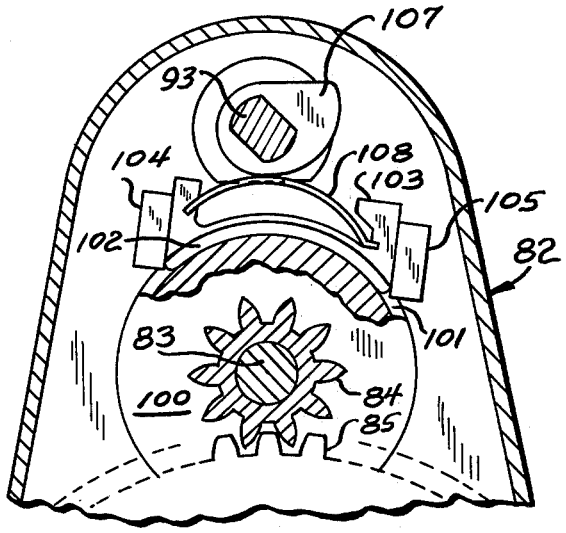
FIG. 6 is a partial section as seen at line 6—6 of FIG. 5, with the release fork removed to illustrate the brake.

FIGS. 5 and 6 illustrate the corresponding chain drum brake applied to a hand brake mechanism of the type utilizing only spur gears as components of the gear drive between the hand wheel 80 and the chain drum 81. Such a brake mechanism, without the chain drum brake, is illustrated and described in U.S. Pat. No. 3,453,902 and reference may be made to that patent for all of the details thereof. Briefly, however, such an apparatus includes a frame 82. Shaft 83 on which the hand wheel 80 is secured is suitably journaled in the frame. A pinion gear 84 is journaled on shaft 83 and is connected to the shaft through a release mechanism, generally 86. Pinion gear 84 engages a spur gear 85 forming the periphery of chain drum 81. When the release mechanism is engaged, pinion gear 84 rotates with shaft 83 and when the release mechanism is disengaged the pinion gear is free to rotate about the shaft.

The release mechanism includes an actuating fork 87 pivotally mounted on a shaft 88 and a spline-engaging release plate 89. When the fork is pivoted in a counterclockwise direction (FIG. 5) it presses against the release plate 89 and moves the release plate to the right, against the resistance of spring 90, to disengage the splines of the release plate from the splines of the hub of pinion gear 84. The fork is so moved by cam 92 secured to release shaft 93. Shaft 93 is journaled in frame 82 and is rotatable by means of a handle 94.

A pawl 95 engages a ratchet wheel 96 in a manner such that when hand wheel 80 is turned in the brake applying direction, the pawl steps along and will hold the hand wheel and shaft 83 in any position thus established. Ratchet wheel 96 is releasably held between a movable locking ring 97 on one side and a flange on the opposite side as described in detail in U.S. Pat. No. 3,453,902. When the brake is to be released slowly, wheel 80 is turned in the reverse direction thus backing locking ring 97 off the ratchet so that it no longer grips ratchet wheel 96 and the wheel 80 then can be turned to cause an unwinding of the chain from the chain drum.

In this embodiment the brake drum for use in retarding the rotation of the chain drum 81 when the release mechanism 86 is released is formed as an integral part of pinion gear 84. This brake drum 100 has a concave vee peripheral surface 101. The convex vee surface 102 of a brake shoe 103 rides on the brake drum surface. Stops 104 and 105 forming a part of frame 82 restrain the brake shoe against movement in a rotational direction about the axis of shaft 83.

A brake actuating cam 107 is secured to release shaft 93. The cam bears against a spring 108 which in turn bears against brake shoe 103. Thus when the handle 94 is turned in a direction such as to release mechanism 86 and permit the free rotation of chain drum 81, the cam 107 applies a force through spring 108 to brake shoe 103 in a direction radially toward the axis of shaft 83. This results in a drag on the brake drum which has a retarding effect on the rotation of pinion gear 84 and spur gear 85 and thus the chain drum 81.

I claim:

1. In a hand brake mechanism for actuating the brake chain of a railway car which mechanism comprises a frame, a first shaft mounted in said frame and defining a first axis, a chain drum mounted on said shaft and rotatable about said axis, a second shaft rotatably mounted in said frame and defining a second axis, a hand wheel secured to said second shaft, and drive means connecting said second shaft and said chain drum for transmitting a rotating force to said chain drum in response to the manual rotation of said hand wheel, the improvement comprising:

said second axis being substantially parallel to said first axis; and said drive means including an interengaging worm and a worm wheel, said worm wheel defining a plane, said worm receiving said rotational force from said hand wheel and transmitting it to the worm wheel from whence it is transmitted to the chain drum, said worm wheel being rotatable about said first axis, a third shaft defining a third axis positioned parallel to said plane, said worm being mounted on said third shaft for rotation about said third axis, a pair of interengaging bevel gears, one of said bevel gears being mounted on said second shaft for rotation about said second axis and operatively connected to said hand wheel for rotation therewith, the other of said bevel gears being mounted on said third shaft for rotation about said third axis and operatively connected to said worm for rotation therewith, whereby the drive means is self-locking so far as forces applied to the chain drum by the brake chain are concerned.

2. In a hand brake mechanism for actuating the brake chain of a railway car which mechanism comprises a frame, a first shaft mounted in said frame and defining a first axis, a chain drum mounted on said shaft and rotatable about said axis, a second shaft rotatably mounted in said frame and defining a second axis, a hand wheel secured to said second shaft, drive means connecting said second shaft and said chain drum for transmitting a rotating force to said chain drum in response to the manual rotation of said hand wheel, and a release mechanism for permitting disengagement so that the chain drum is free to rotate independently of said hand wheel, said release mechanism including an actuating means, the improvement comprising:

said second axis being substantially parallel to said first axis;

said drive means including an interengaging worm and a worm wheel, said worm wheel defining a plane, said worm receiving said rotational force from said hand wheel and transmitting it to the worm wheel from whence it is transmitted to the chain drum, said worm wheel including a hub having splines thereon and being rotatable about said first axis, a third shaft defining a third axis positioned parallel to said plane, said worm being mounted on said third shaft for rotation about said third axis, whereby the drive means is self-locking so far as forces applied to the chain drum by the brake chain are concerned;

said chain drum including a hub having splines thereon and positioned in juxtaposition to said hub of the worm wheel;

a release plate having splines engaging the splines of the two hubs and movable in one direction along said first axis to disengage to release plate splines from the splines of one of said hubs, said release plate having two sides one of which is in said direction from the other of said sides;

resilient means bearing against said one side of said release plate and urging said release plate in the reverse of said one direction;

a release ring positioned in juxtaposition to the other side of the release plate and rotatable about said first axis, said actuating means engaging said ring for rotating said ring; and cam means between said ring and the frame for moving said ring, which in turn moves the release plate, in said one direction as said ring is rotated.

3. In a hand brake mechanism as set forth in claim 2, wherein said chain drum includes a peripheral brake drum surface;

including brake shoe means positioned radially outwardly of said surface and in juxtaposition thereto and movable radially against said surface for frictionally engaging said surface for retarding the rotation of said chain drum; and including means operatively connecting said actuating means and brake shoes means for moving said brake shoe means against said surface as said actuating means is operated to release said release mechanism.

4. In a hand brake mechanism for actuating the brake chain of a railway car which mechanism comprises a frame, a first shaft mounted in said frame and defining a first axis, a chain drum mounted on said shaft and rotatable about said axis, a second shaft rotatably mounted in said frame and defining a second axis, a hand wheel secured to said second shaft, drive means connecting said second shaft and said chain drum for transmitting a rotating force to said chain drum in response to the manual rotation of said hand wheel, and a release mechanism for permitting disengagement so that the chain drum is free to rotate independently of said hand wheel, said release mechanism comprising an actuating means including a third shaft positioned parallel to said first shaft and radially outwardly of said chain drum and a handle secured to said third shaft for manual rotation of the third shaft to disengage the release mechanism, the improvement comprising:

said second axis being substantially parallel to said first axis; and said drive means including an interengaging worm and a worm wheel, said worm wheel defining a plane, said worm receiving said rotational force from said hand wheel and transmitting it to the worm wheel from whence it is transmitted to the chain drum, said worm wheel being rotatable about said first axis, a fourth shaft defining a third axis positioned parallel to said plane, said worm being mounted on said fourth shaft for rotation about said third axis, whereby the drive means is self-locking so far as forces applied to the chain drum by the brake chain are concerned; and a brake for restraining the rotation of the chain drum when the release mechanism is released and including:

said chain drum including a peripheral brake drum surface;

brake shoe means positioned radially outwardly of said surface and in juxtaposition thereto and movable against said surface for frictionally engaging said surface for retarding the rotation of said chain drum; and including means operatively connecting said actuating means and the brake shoe means for moving said brake shoe means against said surface as said actuating means is operated to release said release mechanism and including a cam on said third shaft, and means bearing against said cam and said shoe whereby as said third shaft is rotated said cam applies a force to the last mentioned means in a direction radially toward said first axis and the last mentioned means applies a corresponding force to the shoe urging the shoe against said surface.

5. In a hand brake mechanism as set forth in claim 4, wherein said surface has an annular vee-shaped depression therein, and said shoe has a vee-shaped protrusion seated in said depression; and including means secured to said frame and contacting said shoe for restricting movement of said shoe to a radial movement.

6. In a hand brake mechanism for actuating the brake chain of a railway car which mechanism comprises a chain drum member mounted in said frame for rotation about an axis, hand wheel means rotatably mounted in said frame, drive means connecting said hand wheel means and said chain drum member for transmitting a rotating force to said member in response to rotation of said hand wheel means, said drive means including a release mechanism for permitting disengagement so that the drum member is free to rotate independently of said hand wheel, said release mechanism including an actuating means, and a gear member, and brake means for retarding the rotation of said drum member when said release mechanism is disengaged, the further improvement wherein said brake means comprises:

one of said members including a peripheral brake drum surface;

brake shoe means positioned radially outwardly of said surface and in juxtaposition thereto and movable against said surface for frictionally engaging said surface for retarding the rotation of said chain drum; and including means operatively connecting said release mechanism actuating means and brake shoe means for moving said brake shoe means against said surface as said actuating means is operated to release said release mechanism.

7. In a hand brake mechanism as set forth in claim 6 and wherein said actuating means includes a second shaft radially outwardly of said chain drum member and a handle secured thereto for manual rotation of said second shaft to disengage the release mechanism, the further improvement wherein said last mentioned means comprises:

a cam on said actuating means shaft, and spring means bearing against said cam and said shoe whereby as said actuating means shaft is rotated said cam applies a force to the spring means in a direction radially toward said first axis and the spring means applies a corresponding force to the shoe urging the shoe against said surface.

8. In a hand brake mechanism as set forth in claim 7, wherein said one member is said chain drum member.

9. In a hand brake mechanism as set forth in claim 7, wherein said one member is said gear member.

* * * * *

UNITED STATES PATENT AND TRADEMARK OFFICE

CERTIFICATE OF CORRECTION

PATENT NO. : 4,182,197

DATED : January 8, 1980

INVENTOR(S) : Roland J. Olander

It is certified that error appears in the above-identified patent and that said Letters Patent are hereby corrected as shown below:

Column 1, line 36, delete "the".
Column 2, line 34, "detained" should read --detailed--.
Column 3, line 8, "durm" should read --drum--.
Column 3, line 18, "hole" should read --hold--.
Column 3, line 25, --forming-- should be inserted after "plate".
Column 4, line 3, "releases" should read --release--.
Column 6, line 38, "to" second occurrence, read -- the --.
Column 6, line 61, "shoes" should read --shoe--.

Signed and Sealed this

*Thirteenth* Day of *May 1980*

[SEAL]

*Attest:*

SIDNEY A. DIAMOND

*Attesting Officer*

*Commissioner of Patents and Trademarks*